US008632479B2

(12) United States Patent
Schonenberger

(10) Patent No.: US 8,632,479 B2
(45) Date of Patent: Jan. 21, 2014

(54) WALKING TRAINER

(76) Inventor: Willi Schonenberger, Wadenswil (CH)

( * ) Notice: Subject to any disclaimer, the term of this patent is extended or adjusted under 35 U.S.C. 154(b) by 646 days.

(21) Appl. No.: 12/442,932

(22) PCT Filed: Aug. 23, 2007

(86) PCT No.: PCT/EP2007/007421

§ 371 (c)(1),
(2), (4) Date: Mar. 3, 2010

(87) PCT Pub. No.: WO2008/037328

PCT Pub. Date: Apr. 3, 2008

(65) Prior Publication Data

US 2010/0249674 A1 Sep. 30, 2010

(30) Foreign Application Priority Data

Sep. 27, 2006 (DE) ..... 10 2006 046 921

(51) Int. Cl.

| | |
|---|---|
| ***A61H 1/02*** | (2006.01) |
| ***A63B 22/20*** | (2006.01) |
| ***A63B 22/00*** | (2006.01) |
| ***A63B 22/08*** | (2006.01) |

(52) U.S. Cl.

CPC ..... *A61H 1/0266* (2013.01); *A61H 1/02* (2013.01); *A61H 1/0214* (2013.01); *A61H 1/0255* (2013.01); *A61H 1/0262* (2013.01); *A63B 22/08* (2013.01)

USPC ..... 601/27; 661/33; 661/5; 661/29; 661/34; 482/70

(58) Field of Classification Search

USPC ..... 601/35, 33, 5, 23, 27, 29, 31, 32, 34; 482/52, 54, 70

See application file for complete search history.

(56) References Cited

U.S. PATENT DOCUMENTS

| | | | | |
|---|---|---|---|---|
| 219,439 | A | 9/1879 | Blend | |
| 658,464 | A | 9/1900 | Reinli | |
| 2,210,269 | A | 8/1940 | Taylor | |
| 2,476,617 | A | 7/1949 | Mueller | |
| 3,824,994 | A | 7/1974 | Soderberg, Sr. | 128/25 R |
| 4,925,183 | A | 5/1990 | Kim | |
| 5,451,194 | A | 9/1995 | Harrigan | 482/70 |
| 6,663,539 | B1 * | 12/2003 | Wu | 482/52 |
| 6,666,831 | B1 | 12/2003 | Edgerton et al. | 600/587 |
| 6,821,233 | B1 | 11/2004 | Colombo et al. | |
| 2004/0063549 | A1 | 4/2004 | Kuo | 482/54 |
| 2005/0273022 | A1 | 12/2005 | Diaz et al. | 601/5 |
| 2006/0211957 | A1 * | 9/2006 | Beny et al. | 601/5 |
| 2008/0234113 | A1 | 9/2008 | Einav | |
| 2009/0215589 | A1 | 8/2009 | Schoenenberger | 482/54 |

FOREIGN PATENT DOCUMENTS

| | | | |
|---|---|---|---|
| DE | 20019732 | U1 | 5/2001 |
| DE | 10139276 | A1 | 5/2002 |
| EP | 1120098 | A1 | 8/2001 |
| KR | 20020008760 | | 1/2002 |
| WO | WO2006094018 | A1 | 9/2006 |
| WO | WO2006108457 | A1 | 10/2006 |

* cited by examiner

*Primary Examiner* — Nicholas Lucchesi
*Assistant Examiner* — Brooke Matney
(74) *Attorney, Agent, or Firm* — Seed IP Law Group PLLC

(57) ABSTRACT

A walking trainer having at least one orthotic, with holding devices for the foot or leg area of a user, which is moved along a preset motion track to execute a natural walking movement. Devices in the form of rolling or gliding means are provided on the underside of the orthotic for allowing the orthotic to glide on a surface below the walking trainer.

29 Claims, 4 Drawing Sheets

WALKING TRAINER

BACKGROUND

1. Technical Field

The present disclosure relates to a walking trainer having at least one orthotic, with holding devices for the foot or leg area, which is moved along a preset motion track to execute a natural walking movement, whereby the walking trainer is arranged on a base.

2. Description of the Related Art

Treadmill training has been successfully used for some time in the treatment of paraplegic patients and/or patients suffering from neurological damage and illnesses, whereby mostly a partial body weight relief is made possible by a suspension device. This enables the patient to train the walking movement even if he is unable to walk independently or can only walk with therapeutic assistance. The aim of the exercise is to stimulate the metabolic processes and to maintain the function of the muscles and joints.

Particularly in order to relieve the physiotherapists here, who conventionally have been forced to move the feet of the patient according to a natural walking pattern, there are already various suggestions for providing ambulation training systems with which the patients can train essentially independently on their own. For example, from International Patent Application No. PCT/EP 2006/000523, a walking aid for a mechanically driven treadmill is already known, which comprises at least one tractive element guided over, in each case, two deflection rollers and driven directly or indirectly via the treadmill, whereby the tract of the tractive element that directly faces the treadmill moves in the same direction as the treadmill and the tract of the tractive element that faces away from the treadmill moves in the opposite direction of the treadmill, as well as at least one fixing element, arranged on the tractive element, for holding the feet and/or leg region. This walking aid offers a very simple structure, whereby the position of the two lower legs or feet is firmly set, while simultaneously a very even movement can be ensured through the tractive element.

A corresponding automatic treadmill therapy can be used as an effective standard therapy for numerous movement disorders and for the consequences of injuries for orthopedically/traumatologically ill patients. Examples include hemi-, para- and tetraplegics, spastic paralysis, multiple sclerosis and cranio-cerebral trauma. In addition, such automated treadmill therapy can also be used in geriatrics to maintain the mobility of elderly people.

In particular, because the known walking aid has proven to be extremely effective in practice, there is a need for more extensive walking training for appropriate patients, but particularly, however, also for patients who have already regained a certain degree of their mobility, or patients who should continue to be given the possibility of essentially independent training. Furthermore, there is a need for the provision of a walking aid or walking trainer with which it is also possible to treat the patients directly on the spot, meaning in their own rooms.

BRIEF SUMMARY

Embodiments of the present invention provide a simple walking trainer which produces a movement similar to natural walking and so gives patients their independence back. The walking trainer includes at least one orthotic with holding devices for the foot or leg area of a user which is moved along a preset motion track to execute a natural walking movement, and whereby the walking trainer is arranged on a base in such a way that rolling or gliding means, which allow movement of the orthotic relative to the base, are provided between the orthotic and the base.

The walking trainer according to various embodiments of the invention consequently provides an independent training means which is not dependent on the orthotic moving together with a base, such as, for example, a treadmill, so that the walking trainer can be formed in such a way that it is considerably more compact than already-known devices. This also makes it possible to change the location of the walking trainer easily, because no special requirements are placed on the base, as a result of which it is made possible for the walking trainer to be brought directly to the patient by the therapeutic personnel, without the patient having to go to the therapist.

According to one embodiment, the base can be stationary with respect to the walking trainer. Consequently, any bottom surface can form the base of the walking trainer, so that no special requirements must be met with regard to the bottom surface.

On an underside of each orthotic, rolling or gliding means can preferably be provided, by means of which the orthotic can glide on the bottom surface. The arrangement of the rolling or gliding means below the orthotic additionally stabilizes the foot of the user during the movement. At the same time, it is possible to set up the orthotic in a compact manner, without a hindrance resulting for the user during use.

According to another embodiment, means for attaching at least two wheels to the underside of the orthotic can be formed. In this case, at least two wheels have proven satisfactory in practice, in order to stabilize the orthotic during the movement across the bottom surface.

According to a further preferred embodiment, the underside of each orthotic can be formed as a roller skate. The form and arrangement of the wheels on roller skates have proven satisfactory for a long time, and can be transferred to the present orthotic. In this case, the form of classic roller skates, with two pairs of wheels, one pair arranged behind the other, and also that of inline skates, with a number of wheels arranged in a row, one behind the other, can similarly be used.

According to another embodiment, the orthotic can be moved along the preset motion track by means of its own drive. In this way, it is possible to selectively control the motion sequence of the orthotic without it being indirectly driven. At the same time, the walking trainer can also be designed so that it is as compact as possible.

The drive of the orthotic can advantageously be guided along the preset motion track at various speeds. As a result of the provision of a separate drive for the orthotic, it is possible for the first time to take into account the various speeds during the standing phase and the sweeping phase of the legs. To this end, the drive can correspondingly be regulated via software or the like, so that a higher speed is preset during the sweeping phase.

According to one embodiment, the drive can be provided by an electric motor. In this connection, an electric motor has proven to be particularly preferable because it can be easily integrated into the walking trainer, while it simultaneously provides the possibility of selecting various speeds. According to another embodiment, the orthotic can be connected to a tractive element guided via two deflection rollers, whereby the drive drives the tractive element and/or the deflection rollers. In this way, it is possible to move the orthotic via a very simple means in such a way that a natural walking movement is executed, whereby the number of moving parts can be reduced to a minimum. In this case, the orthotic is also guided by the moving tractive element.

The deflection rollers can advantageously be of different sizes, whereby the larger deflection roller is arranged at the back. In this way, it is possible to achieve the required movement pattern, meaning a natural walking movement, in a simple manner.

According to other embodiments, the motor can drive the tractive element directly or indirectly. This is a particularly simple manner of exercising the movement of the walking trainer. According to one embodiment, the motor can be connected to the tractive element or to a deflection roller, or assigned to the same, in order to move the entire system in this way. The motor can furthermore be arranged in a stationary manner within the housing of the walking trainer. In this way, the weight of the motor can simultaneously contribute to the stabilization of the walking trainer.

The walking trainer can advantageously have four deflection rollers, with two tractive elements, each assigned to two deflection rollers, whereby the tractive elements are arranged parallel to each other and each tractive element is connected to an orthotic. As a result of this embodiment, an independent orthotic is assigned to each leg, i.e., the two orthotics are moved independently of one another, so that a very wide range of movement sequences can be carried out here. In particular, the position of each orthotic relative to the other can be changed as needed.

In this case, the two tractive elements can be separated from each other by a separating panel. In this way, each tractive element, together with the assigned orthotic, is an independent element, without it being possible for it to be influenced by the other tractive element. At the same time, maintenance and repair are simplified.

According to another embodiment, each tractive element can be given its own drive. If two motors are provided in order to drive the tractive elements of each individual orthotic, it is particularly possible to take into account the different speeds of the legs, because the two sides are not driven synchronously with each other, as would be the case if driven via the walking surface of a treadmill, but instead, each foot can be moved independently of the other in accordance with the natural motion sequence, so that the movement achieved in this way is identical to natural walking and the patient achieves an optimal training effect.

The orthotics can advantageously be arranged on diametrically opposite positions of the tractive elements. This position has proven to be the most advantageous for a natural motion sequence, but it is equally possible, however, because the tractive elements are arranged independently of each other, also to arrange the orthotics in any position of the tractive elements, in order in this way to execute various movement patterns.

According to another embodiment, the tractive element can be formed as a toothed chain and the deflection rollers can be formed as chain wheels. The use of chain wheels and chains represents a very simple means of carrying out the intended movement. The system comprising chains and chain wheels is easy to maintain and chain and chain wheel components have been tried and tested for a long time.

In another embodiment, the tractive elements can be toothed belts.

According to yet another embodiment, each tractive element can be provided with an attachment and/or guide element, to which the orthotic can be connected. A corresponding attachment and/or guide element serves the simple connection of the orthotic to the tractive elements.

The attachment and/or guide element can advantageously be formed as a support element that protrudes outwards perpendicularly from the tractive element.

A foot area of the orthotic can advantageously have a through hole for leading through the attachment and/or guide element.

The provision of a support element is, in turn, a very simple means of connecting the orthotic to the tractive element and simultaneously guaranteeing the mobility of the orthotic relative to the tractive element, because the orthotic is not arranged in a stationary manner on the support element, but instead the support element is held in the through hole in the orthotic in such a way that it can move. At the same time, it is possible to attach various orthotics, for example, orthotics for various shoe sizes, to the support element.

The attachment and/or guide element can advantageously be formed to be longer than the through hole of the orthotic and it can be possible to connect it to securing elements on the end protruding from the orthotic in such a way that it can be detached. This ensures that the orthotic is held on the support element in such a way that it can move, while it is ensured that it cannot slip off of the support element. In this case, it can advantageously be provided for the securing element to be a nut that can be screwed on to a correspondingly screw-like formed area of the attachment and/or guide element. The formation of a screw section and a nut here represents a particularly simple means of securing the orthotic to the support element. The securing element can furthermore also be formed as a metal cap, which closes like a spring lock and so is easy and simpler to use.

According to a further embodiment, the tractive element can be arranged in a housing, whereby a slot-shaped opening is formed in either side of the housing for leading through the attachment and/or guide element. The provision of the housing enhances safety, because the patient does not come directly into contact with the moving parts, which means the tractive element and the electric motor, in order to rule out possible injuries. At the same time, by means of the provision of a slot-shaped opening on either side of the housing, a guide is provided along which the attachment and/or guide element moves and on the edge of which it lies, so that it is additionally stabilized in this manner.

The slot-shaped opening can advantageously be formed in accordance with a natural walking movement, which means that the slot-shaped opening corresponds to the movement executed while walking. In this case, it is possible to provide various walking trainers, in which the slot-shaped openings are formed in different ways, so that different movement patterns, for example, walking, running, etc., can be copied.

According to a further embodiment, it can be provided for frame elements to be arranged on the front and back ends of the walking trainer. Appropriate frame elements support a secure, solidly positioned standing position of the walking trainer.

The frame elements can advantageously be formed so that they fold out. In this way, it is possible to increase the base of the walking trainer considerably, in order to prevent the walking trainer from tipping over.

According to another embodiment, the walking trainer can be provided with a handle on its upper side. This embodiment has proven to be particularly advantageous when the walking trainer is to be brought to the patient by the therapist, and also when the therapy areas are to be rearranged.

The walking trainer can furthermore additionally have a handhold element to which the patient can hold on while training. A corresponding handhold element can be formed here in such a way that it is permanently attached or that it can be inserted.

BRIEF DESCRIPTION OF THE SEVERAL VIEWS OF THE DRAWINGS

Embodiments of the present invention are explained below with reference to the attached drawings. Shown are:

FIGS. 1 to 4 show embodiments of the walking trainer according to the invention, whereby the same components are provided the same reference numbers.

DETAILED DESCRIPTION

Figure 1:
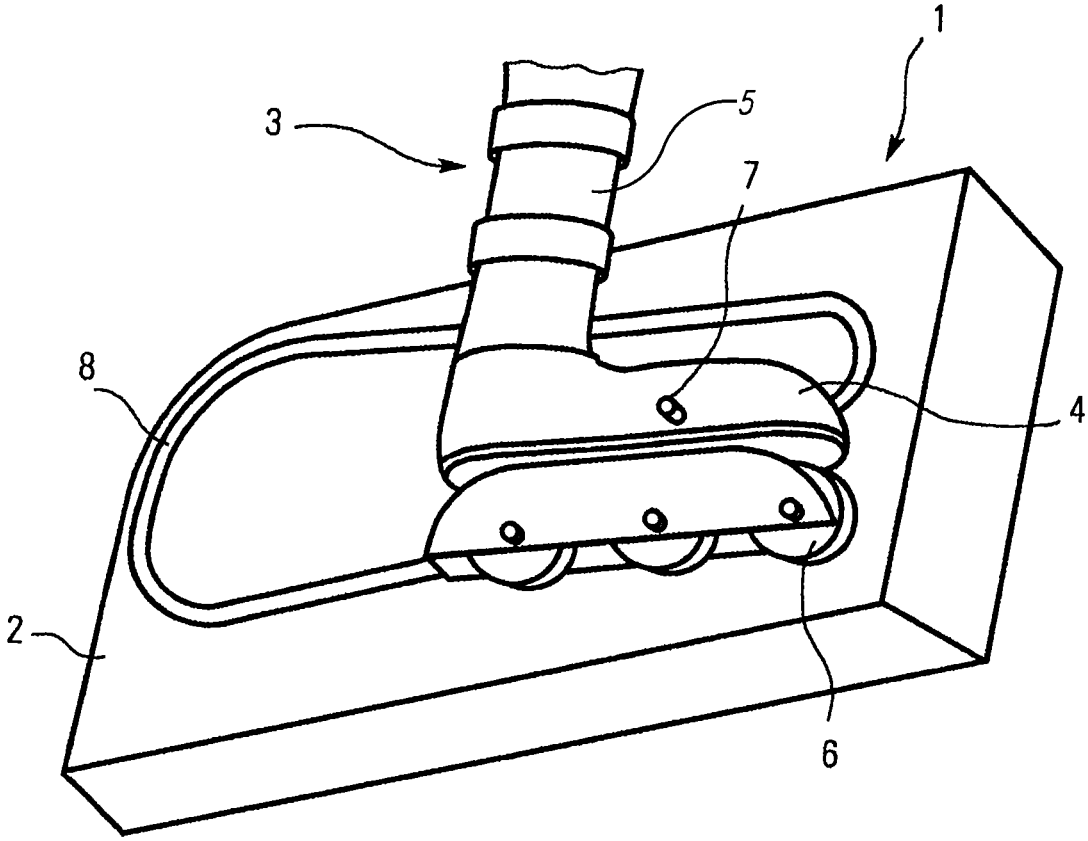
FIG. 1 a three-dimensional perspective view of a side area of the walking trainer according to one embodiment of the invention, in addition to an area of the underside of the walking trainer.
Figure 2:
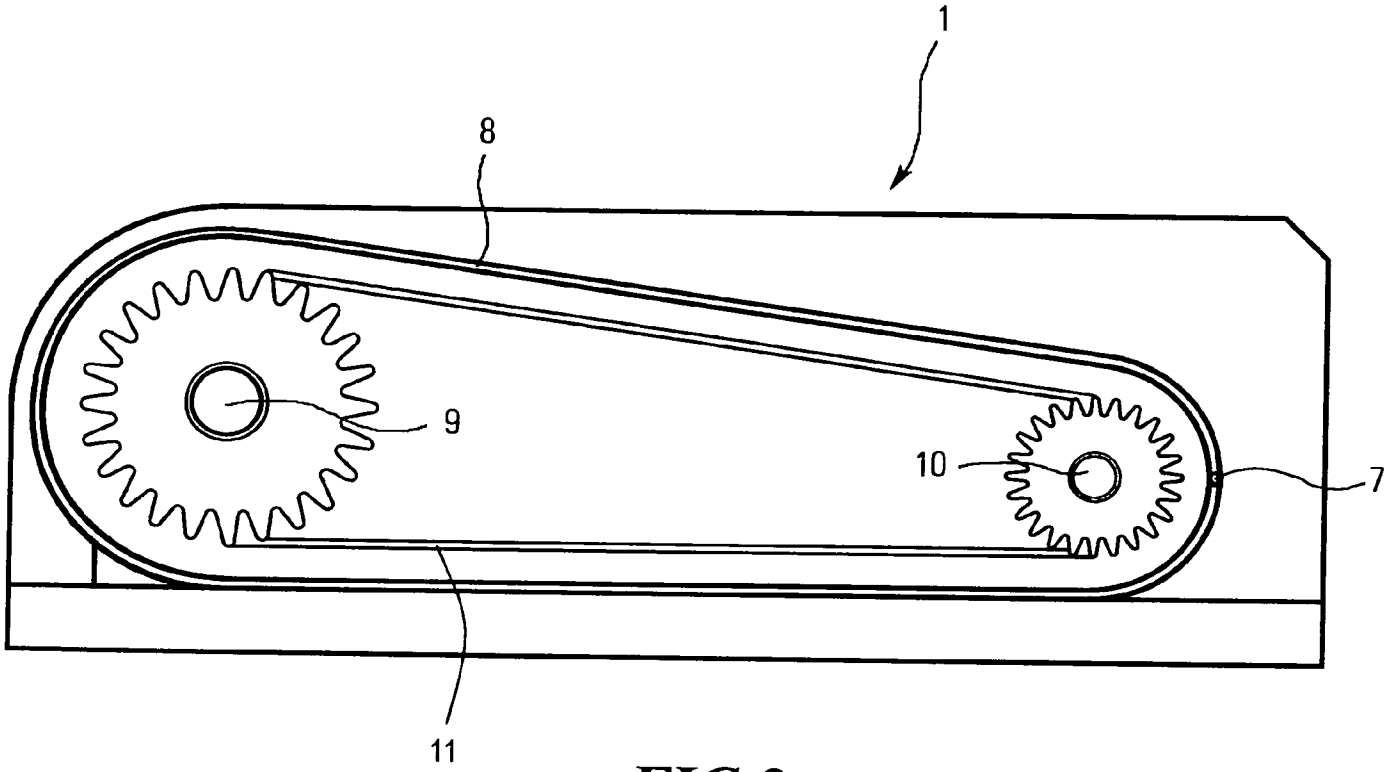
FIG. 2 a cross-sectional side view through the length of the walking trainer shown in FIG. 1.

As shown in FIGS. 1 and 2, the walking trainer 1 according to one embodiment of the invention comprises a housing 2, with orthotics 3 arranged on either side of the sides of the outside, which are movable by means of the mechanism arranged in the interior of the housing 2.

Each orthotic 3 comprises a foot-holding or foot-receiving element 4, as well as holding devices 5 for the leg area. Both the holding devices 5 and the foot-holding/receiving element 4 can be attached to the body of the patient by means of hook-and-loop fasteners or other suitable means.

On the underside of the orthotic 3, i.e., on the underside of the foot-holding element 4, rollers 6 are arranged in such a way that when there is a movement of the walking trainer 1, the orthotic is rolled across the bottom when in contact with the bottom. The individual rollers here can be attached to the underside of the orthotic by means of a chassis or by bearings, comparable to the arrangement on roller skates, skateboards or inline skates. Similarly, the rollers can be arranged next to one another in pairs or in a row. Embodiments of the present invention, however, may also comprise any additional means by means of which the orthotic can roll or glide across the bottom, e.g., ball elements or glide elements.

The orthotic 3 is connected to the movement mechanism by means of an attachment and/or guide element 7, which protrudes from the interior of the housing and which is connected to the orthotic 3. For this purpose, the orthotic 3 has a penetration opening in the area of the sole of the foot-holding element 4, whereby the attachment and/or guide element 7 can be inserted through this penetration opening. The attachment and/or guide element 7 is fixed in place on the side away from the housing by means of a suitable element in order to prevent the orthotic 3 from slipping.

The movement of the walking trainer 1 is transferred to the orthotic 3 via the attachment and/or guide element 7, and the orthotic 3 is guided along the preset movement by means of the attachment and/or guide element 7. To this end, the housing 2 is provided with a slotshaped opening 8, through which the attachment and/or guide element 7 extends and along which it is guided.

The shape of the slot-shaped opening 8 consequently corresponds to the movement executed by the patient.

FIG. 2 shows a side view of the walking trainer 1, partially in a cut view, in order to explain the drive of the orthotic 3 in more detail. The drive comprises two chain wheels 9 and 10 which are connected to each other by means of a chain 11 and which serve as deflection rollers.

The rear chain wheel 9 is formed so that it is larger than the front chain wheel 10 and the chain wheels are arranged with respect to each other in such a way that the chain 11 runs parallel to the bottom surface in the area near the bottom surface and in the area away from the bottom surface it is guided down at a specified angle from the rear chain wheel 9 to the front chain wheel 10. The shape of the chain given by the chain wheels here corresponds to the motion sequence executed by the walking trainer and is also reflected in the shape of the slotshaped opening 8.

The attachment and/or guide element 7 shown in FIG. 1 is directly connected to the chain and extends perpendicularly from the chain outwards. In this case, the attachment can be made to only one chain element or, for better stabilization, to a plurality of chain elements. The attachment and/or guide element 7 extends from the chain outwards and rests on an edge of the slot-shaped opening 8.

The housing 2 primarily serves to protect the patient in order to rule out risks of injury here. At the same time, the housing also provides the guide for the attachment and/or guide element 7, so that the weight of the orthotic is not resting exclusively on the chain.

The walking trainer is driven by a motor, which is not shown and which can be arranged either inside the housing or outside the housing. The motor can preferably be connected to a chain wheel, in order to drive the other chain wheel and the chain in this manner. According to another embodiment, the chain can also be directly driven by the motor.

In the embodiments as shown in FIGS. 1 and 2, only one side of the walking trainer 1 is shown in each case. The other side of the walking trainer 1 here is formed in a mirror-inverted manner, whereby the two orthotics 3 are preferably arranged at diametrically opposed positions. Although both orthotics can be moved by the very same chain, it has proven advantageous for each orthotic to have its own drive mechanism. The two drive mechanisms in this case are set up parallel to each other and can be separated from each another by a separating panel 12 (FIG. 3).

It has furthermore proven to be preferable if each orthotic has its own drive so that the speed of each orthotic can be regulated separately. In this way, different speeds in the standing phase (approx. 40%) and in the sweeping phase (approx. 60%) can be taken into account and correspondingly executed. The two drives can, e.g., be controlled by a computer.

Figure 3:
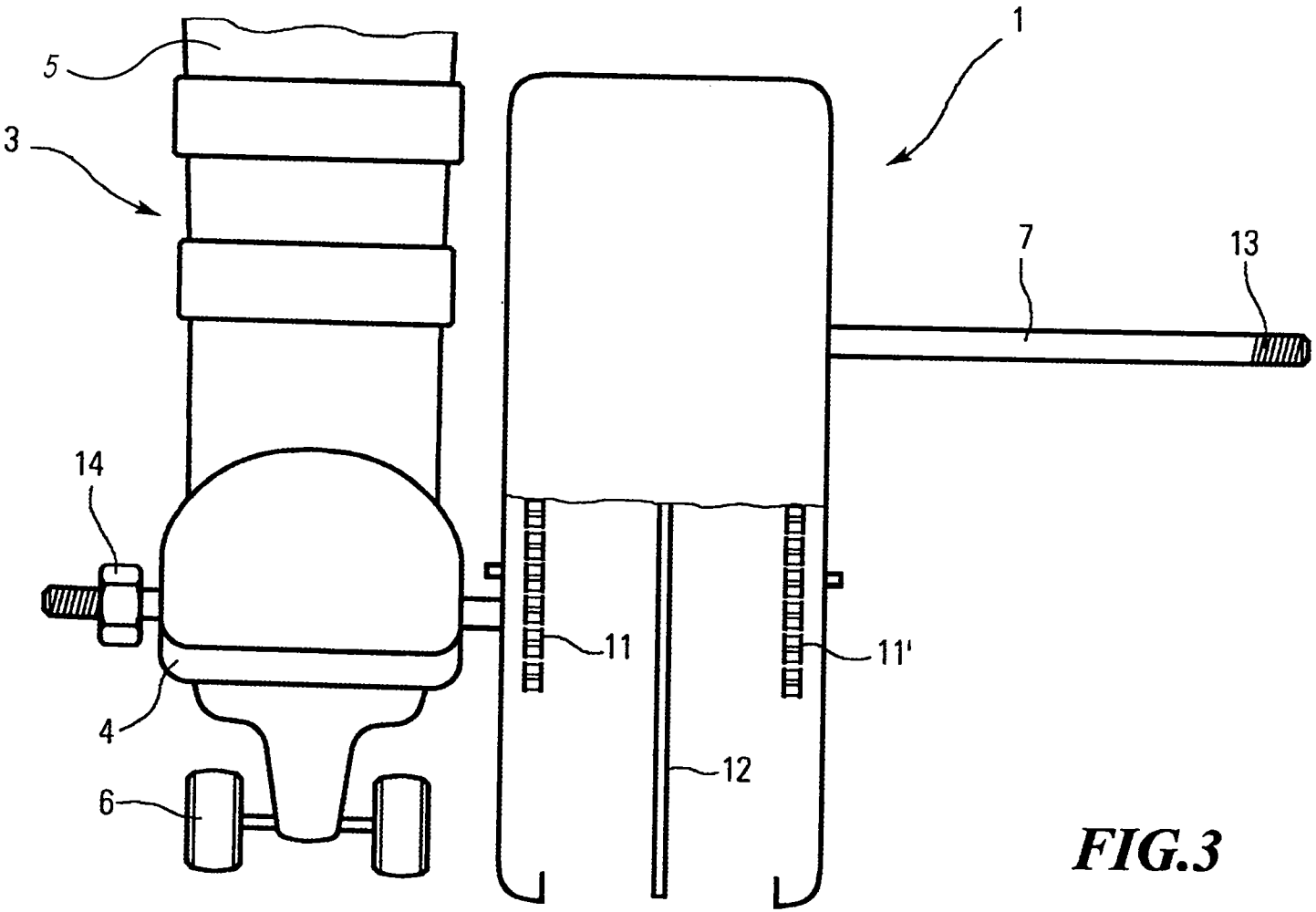
FIG. 3 a front view of the walking trainer according to one embodiment of the invention, whereby an orthotic is attached on only one side, and whereby the housing is shown partially removed.
Figure 4:
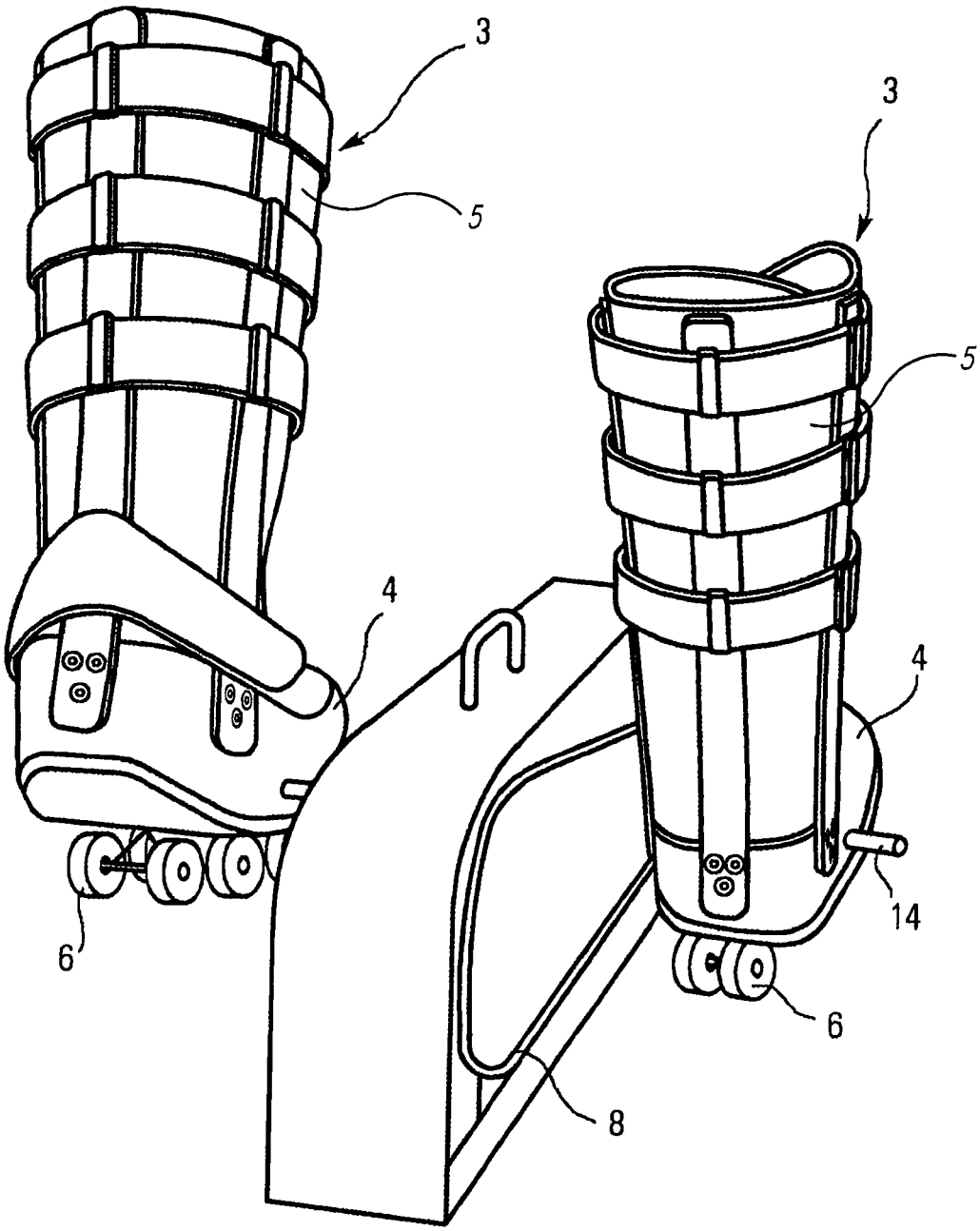
FIG. 4 a three-dimensional perspective view of the walking trainer according to one embodiment of the invention, shown from behind.

The arrangement of the two chains 11, 11" within the housing 2 is shown in FIG. 3. A separating panel 12 is arranged between the two chains that run parallel to each other, in order to prevent either chain from influencing the other. An attachment and/or guide element 7, which is formed in the shape of a rod, extends perpendicularly outwards from each chain. The end of each rod that lies away from each chain is provided with a threaded area 13, on to which a nut 14 can easily be screwed, after the orthotic 3 has been slid on to the rod, in order in this way to prevent the orthotic from slipping off.

The housing 2 must be formed so that the orthotics 3 are positioned in order to guarantee that the rollers of the orthotics are in contact with the bottom surface during a portion of the execution of the movement. Similarly, the housing 2 can also be provided with frame elements that guarantee the appropriate height of the orthotics 3. To prevent the walking trainer 1 from tipping, additional elements can also be provided to fix it in place, whereby if necessary, these elements can also be formed so that they fold out.

Because of its compact design, the walking trainer according to embodiments of the invention can also be taken on house calls by therapists, so that it consequently allows a broad range of uses. The patient here can be attached to the orthotics in either a sitting or standing position (in which case, with additional handhold elements), and the corresponding preset movement exercises can be executed.

Similarly, the walking trainer can be used in combination with a conventional relief system for the patients, particularly for stabilizing the patient while standing or walking.

The invention claimed is:

1. A walking trainer operable on a base surface, comprising:

a portable housing having a closed loop slot-shaped opening on a side thereof to define a preset motion track;

at least one orthotic having a holding device for a foot of a user, the at least one orthotic coupled to the portable housing to move along the preset motion track in a looping manner to execute a walking movement; and at least one rolling or gliding device coupled to the orthotic and configured to, during a portion of movement of the orthotic along the preset motion track, facilitate movement of the orthotic relative to the base surface while the rolling or gliding device is in contact with the base surface.

2. The walking trainer of claim 1, wherein the portable housing is stationary with respect to the base surface when the walking trainer is in use.

3. The walking trainer of claim 1, wherein the rolling or gliding device is coupled to an underside of the orthotic and positioned to roll or glide on the base surface during a portion of movement of the orthotic along the preset motion track.

4. The walking trainer of claim 3, wherein the underside of the at least one orthotic includes attachment means for the rolling or gliding device, and wherein the rolling or gliding device has a plurality of wheels.

5. The walking trainer of claim 3, wherein the underside of the orthotic is coupled to the rolling or gliding device, and wherein the rolling or gliding device includes a plurality of wheels arranged as a roller skate.

6. The walking trainer of claim 1, further comprising:

at least one drive, and wherein the orthotic is configured to move along the preset motion track via the drive.

7. The walking trainer of claim 6, wherein the drive is adapted to guide the orthotic along the preset motion track at different speeds.

8. The walking trainer of claim 6, wherein the drive is an electric motor.

9. The walking trainer of claim 1, further comprising:

a traction mechanism guided via two deflection rollers, the traction mechanism connected to the at least one orthotic.

10. The walking trainer of claim 9, wherein the deflection rollers are of different sizes, and wherein the larger deflection roller is arranged at a back of the walking trainer.

11. The walking trainer of claim 9, wherein a motor drives the traction mechanism.

12. The walking trainer of claim 9, further comprising:

a complementary traction mechanism guided via two deflection rollers, the traction mechanism and complementary traction mechanism arranged parallel to each other and each traction mechanism being connected to a respective orthotic.

13. The walking trainer of claim 12, further comprising:

a separating element arranged between the traction mechanisms.

14. The walking trainer of claim 12, further comprising:

a separate drive for each traction mechanism.

15. The walking trainer of claim 12, wherein the orthotics are arranged at diametrically opposite positions of the traction mechanisms.

16. The walking trainer of claim 12, further comprising:

an attachment element coupled to each traction mechanism to which each respective orthotic can be connected.

17. The walking trainer of claim 16, wherein each attachment element protrudes outwards perpendicularly from each respective traction mechanism.

18. The walking trainer of claim 16, wherein a foot area of each respective orthotic has a through hole to receive a respective attachment element.

19. The walking trainer of claim 16, wherein each attachment element is longer than the through hole of the respective orthotic and adapted to removably receive a securing element on the end protruding from the respective orthotic.

20. The walking trainer of claim 19, wherein the end of each attachment element is threaded to receive the securing element, and wherein each securing element is a nut.

21. The walking trainer of claim 19, wherein the end of each attachment element is adapted to receive a securing element in the form of a metal cap.

22. The walking trainer of claim 9, wherein the traction mechanism is arranged in the portable housing.

23. The walking trainer of claim 1, further comprising:

frame elements arranged on a front end and a back end of the walking trainer.

24. The walking trainer of claim 23, wherein the frame elements are configured to fold out.

25. The walking trainer of claim 1, further comprising:

a handle coupled to an upper side of the walking trainer.

26. The walking trainer of claim 1, wherein the walking trainer has a handhold element as a support for the hand of a user.

27. The walking trainer of claim 1, wherein the walking trainer includes a pair of orthotics, and wherein the portable housing has a complementary closed loop slot-shaped opening on an opposing side thereof, the closed loop slot-shaped opening and the complementary closed loop slot-shaped opening each defining a preset motion track to execute a walking movement of the pair of orthotics.

28. A walking trainer operable on a base surface, comprising:

a portable housing having a slot-shaped opening on a side thereof to define a preset motion track;

at least one orthotic having a holding device for a foot of a user, the at least one orthotic coupled to the portable housing to move along the preset motion track to execute a walking movement; and at least one rolling or gliding device coupled to the orthotic and configured to, during a portion of movement of the orthotic along the preset motion track, facilitate movement of the orthotic relative to the base surface, and wherein the slot-shaped opening includes a profile to guide the at least one rolling or gliding device into intermittent contact with the base surface during operation.

29. A walking trainer for use on a base, comprising:

a portable housing having a slot-shaped opening on a side thereof to define a preset motion track to execute a walking movement;

at least one orthotic having a holding device for the foot or leg area of a user, the at least one orthotic coupled to the portable housing to move along the preset motion track to execute the walking movement; and a rolling or gliding device provided between the at least one orthotic and the base to facilitate movement of the orthotic relative to the base, and wherein the slot-shaped opening includes a profile to guide the rolling or gliding device into intermittent contact with the base during operation.

* * * * *